US010480756B1

(12) United States Patent
Oh et al.

(10) Patent No.: US 10,480,756 B1
(45) Date of Patent: Nov. 19, 2019

(54) LIGHT FIXTURE WITH FOCUSABLE LED LIGHT BULB FROM INSIDE THE HEAT SINK

(71) Applicants: Kwang J. Oh, La Crescenta, CA (US); Heidi Oh, La Crescenta, CA (US); Loren Oh, Irvine, CA (US); Austin Oh, Azusa, CA (US)

(72) Inventors: Kwang J. Oh, La Crescenta, CA (US); Heidi Oh, La Crescenta, CA (US); Loren Oh, Irvine, CA (US); Austin Oh, Azusa, CA (US)

( * ) Notice: Subject to any disclaimer, the term of this patent is extended or adjusted under 35 U.S.C. 154(b) by 80 days.

(21) Appl. No.: 15/980,654

(22) Filed: May 15, 2018

Related U.S. Application Data

(60) Provisional application No. 62/576,976, filed on Oct. 25, 2017, provisional application No. 62/585,488, filed on Nov. 13, 2017, provisional application No. 62/637,748, filed on Mar. 2, 2018.

(51) Int. Cl.
*F21V 14/06* (2006.01)
*F21V 29/70* (2015.01)
*F21Y 115/10* (2016.01)

(52) U.S. Cl.
CPC ..... *F21V 14/06* (2013.01); *F21V 29/70* (2015.01); *F21Y 2115/10* (2016.08)

(58) Field of Classification Search
CPC ..... F21V 14/06; F21V 29/70; F21Y 2115/10
See application file for complete search history.

(56) References Cited

U.S. PATENT DOCUMENTS 9,239,150 B2 * 1/2016 Sieberth ..... F21V 15/01
2009/0256697 A1 * 10/2009 Tallinger ..... B60Q 1/2611 340/472
2011/0205742 A1 * 8/2011 Lee ..... F21V 5/04 362/294
2011/0285292 A1 * 11/2011 Mollnow ..... F21S 10/02 315/113
2016/0018588 A1 * 1/2016 Parker ..... F21S 2/005 362/613
2016/0161094 A1 * 6/2016 Oh ..... B60Q 1/2611 362/324

* cited by examiner

*Primary Examiner* — Anh T Mai
*Assistant Examiner* — Glenn D Zimmerman
(74) *Attorney, Agent, or Firm* — John K. Park; Park Law Firm

(57) ABSTRACT

A focusable lighting system is provided, comprising a base body, a first light source light source, a cover body, second light sources, convex lenses, and focus controllers. The first light source is disposed on the front surface portion of the base body. The cover body has a front opening portion connected to an inside of the cover body, a rear cover portion, top and bottom edge portions provided between the front opening portion and the rear cover portion, and two side portions. Each focus controller is installed on each convex lens in the inner space portion of the cover body and configured for controlling a distance between the corresponding second light source and convex lens and providing a light beam ranging from a directional narrow focused spot light to a wide spreading flood light.

18 Claims, 14 Drawing Sheets

Fig. 17
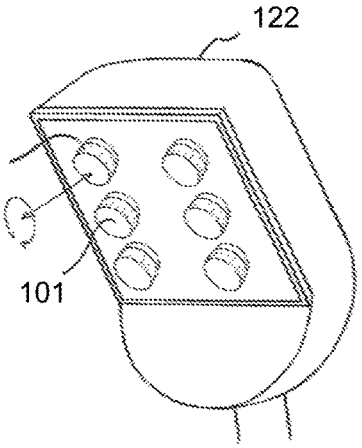
Fig. 16
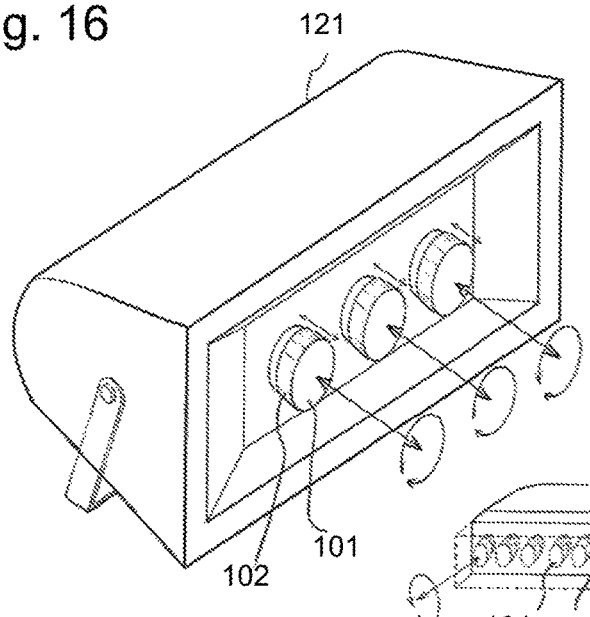
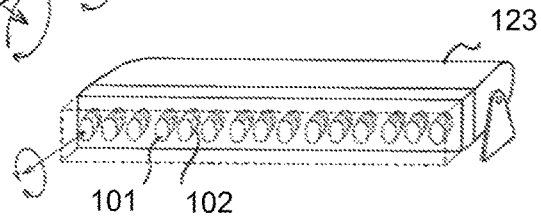
Fig. 18

LIGHT FIXTURE WITH FOCUSABLE LED LIGHT BULB FROM INSIDE THE HEAT SINK

RELATED APPLICATION

This application is a Non-provisional Application of Provisional Application Ser. Nos. 62/486,402 for "Adjustable Focus LED Spotlight from Inside of LED Light Bulb or Fixtures with Interchangeable Bulb" filed on May 15, 2017, 62/576,976 for "Multi-adjustable Focus with Motor and Directional Inside LED Fixture" filed on Oct. 25, 2017, 62/585,488 for "LED Motor Controlled Spot Light with Built-in Flood Light on Cover" filed on Nov. 13, 2017, and 62/637,748 for "LED Light Bar with Motor Controlled Focusable LED Light on Inside the Heat Sink" filed on Mar. 2, 2018.

BACKGROUND OF THE INVENTION

The present invention relates to a focusable lighting system.

A need for a Light Fixture With Focusable LED LIGHT BULB From Inside The Heat Sink has been present for a long time considering the expansive demands in the everyday life. This invention is directed to solve these problems and satisfy the long-felt need.

SUMMARY OF THE INVENTION

The present invention contrives to solve the disadvantages of the prior art.

An aspect of the invention provides a focusable lighting system, comprising a base body, a first light source light source, a cover body, one or more second light sources, one or more convex lenses, and a plurality of focus controllers.

The base body has front and rear surface portions, top and bottom surface portions, and two side surface portions.

The first light source is disposed on the front surface portion of the base body.

The cover body has a front opening portion connected to an inner space portion of the cover body, a rear cover portion, top and bottom edge portions provided between the front opening portion and the rear cover portion, and two side portions.

Each of the one or more second light sources is disposed on a top surface of a first cylindrical platform in the inner space portion of the cover body, so as to illuminate a front side of the front opening portion through the front opening portion.

Each of the one or more convex lenses has a second cylindrical platform being installed on each of the one or more second light sources.

Each of the plurality of focus controllers is installed on each of the one or more convex lenses in the inner space portion of the cover body and configured for controlling a distance between the corresponding second light source and convex lens and providing a light beam ranging from a directional narrow focused spot light to a wide spreading flood light.

Each of the one or more focus controllers may be controlled remotely from outside.

Each of the one or more convex lenses may engage with a corresponding one of the one or more second light sources through male and female threads.

The male threads may be provided on an outer circumferential side surface of the first cylindrical platform and the female threads are provided on an inner surface of the second cylindrical platform, so that the male threads and the female threads engage and rotate against each other so as to change the distance between the second light source and the convex lens.

Each of the plurality of focus controllers may comprise a screw portion, and one or more gears.

The screw portion is provided on an outer surface of the second cylindrical platform of the convex lens, and at least one of the one or more gears engages the screw portion. At least one of the one or more gears is rotated by an electric motor.

Each of the plurality of focus controllers may be configured to rotate one or more convex lenses.

The focusable lighting system may further comprise a hinge tube rod, a cover base board, two rod holes, a connecting rod, and an open-close motor.

The hinge tube rod has one end fixed to the cover body and another end to an outer circumferential surface of which a hinge gear is fixed.

The cover base board has a horizontal plate portion, two vertical side plate portions extending from two edge portions of the horizontal plate portions.

The two rod holes are provided through the two vertical side plate portions.

The connecting rod is queued through the two rod holes and a center through-hole of the hinge tube rod, connecting rotatably the cover body to the cover base board.

The open-close motor has a motor rod rotatably anchored to one of the two vertical side plate portions and a motor gear that is configured to engage the hinge gear and close or open the cover body over the front surface portion of the base body.

The focusable lighting system may further comprise a connector rod, a swiveling gear, and a swiveling motor.

The connector rod extends downwards vertically from the cover base board into the base body.

The swiveling gear is fixed to a lower end of the connector rod.

The swiveling motor is provided in the base body and having a motor gear engaging the swiveling gear, which are configured to swivel the cover base board and the cover body together by rotating the connector rod.

Both ends of the connecting rod may be fixed to the two vertical side plate portions with two handle knobs.

The focusable lighting system may further comprise a circuit board having a first circuit portion for operating the first and second light sources and a second circuit portion for operating the open-close motor and the swiveling motor.

The circuit board may further comprise a third circuit portion for communicating with an remote control through a wired or wireless communication.

In certain embodiments of the invention, each of the one or more focus controllers may be controlled manually.

Each of the plurality of focus controllers may be disposed in the inner space portion of the cover body, installed on the second cylindrical platform of a corresponding convex lens, and configured for controlling a distance between the corresponding second light source and convex lens and providing a light beam ranging from a directional narrow focused spot light to a wide spreading flood light by rotating an outer handle portion of the corresponding convex lens manually.

Each of the one or more convex lenses engages with a corresponding one of the one or more second light sources through male and female threads.

The male threads may be provided on an outer circumferential side surface of the first cylindrical platform and the female threads are provided on an inner surface of the second cylindrical platform, so that the male threads and the female threads engage and rotate against each other so as to change the distance between the second light source and the convex lens.

Each of the plurality of focus controllers may be disposed in the inner space portion of the cover body, installed on the second cylindrical platform of a corresponding convex lens, and configured for controlling a distance between the corresponding second light source and convex lens and providing a light beam ranging from a directional narrow focused spot light to a wide spreading flood light by pushing in or out the corresponding convex lens manually.

Each of the one or more convex lenses may engage with a corresponding one of the one or more second light sources through a side screw handle provided on the first cylindrical platform of the convex lens and a side screw provided along a rectangular cutout through the second cylindrical platform of the convex lens, so as to be configured that the side screw handle of the convex lens is latched at a notch of the side screw, providing a specific interval between the convex lens and the second light source.

The first cylindrical platform of the convex lens may be provided along an edge portion of the convex lens.

The advantages of the present invention are: (1) the focusable lighting system provides an efficient system and method for focusing illumination; and (2) the focusable lighting system according to the invention provides a maximum protection for the apparatus.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIGS. 16-18 are perspective view showing focus controlled LED light on different light devices according to still another embodiment of the invention;

DETAILED DESCRIPTION EMBODIMENTS OF THE INVENTION

Figures 1, 2A, 2B:
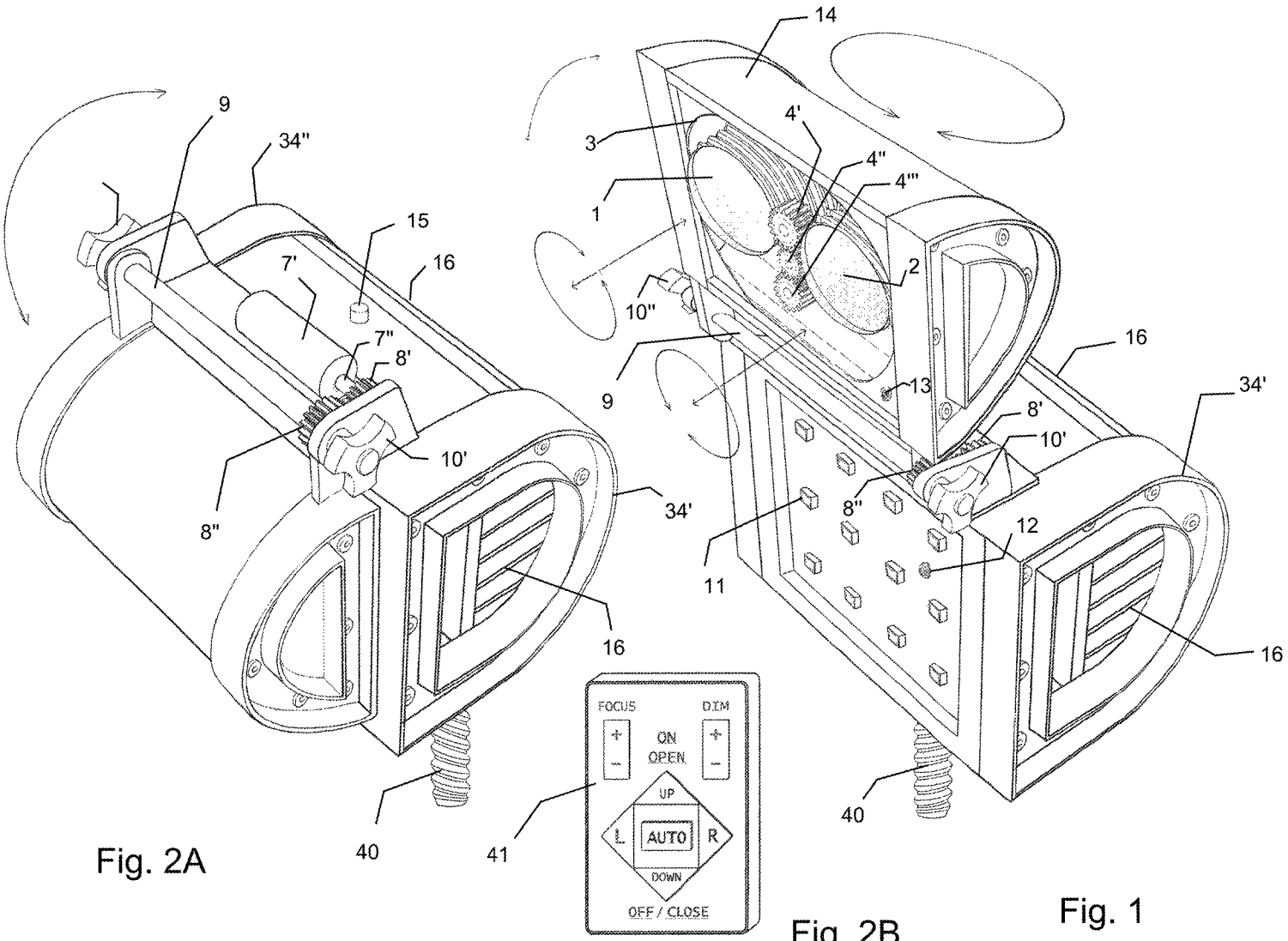
FIG. 1 is a perspective view of an opened cover of a light fixture with a focusable LED light bulb from inside heat sink according to an embodiment of the invention.
FIG. 2A is a perspective view of a closed cover of light fixture with a focusable LED light bulb from inside heat sink according to an embodiment of the invention.
FIG. 2B is a diagram showing a remote for controlling behaviors of the focusable lighting system according to an embodiment of the invention.
Figure 3B:
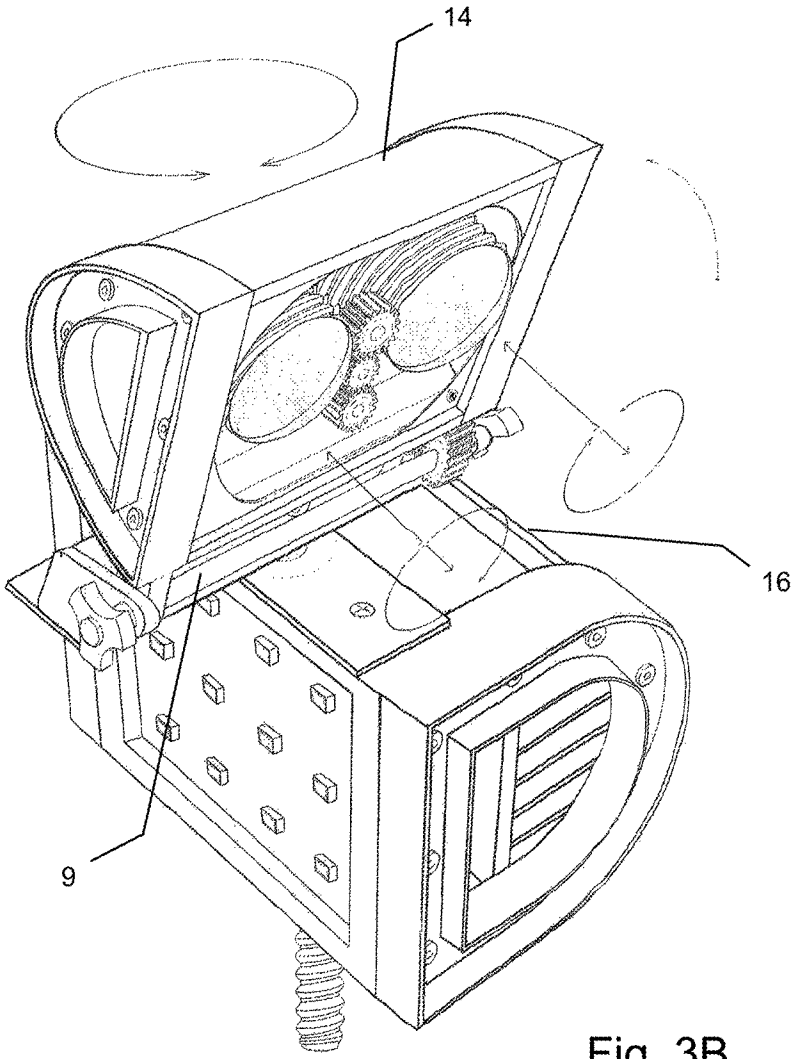
FIG. 3A and FIG. 3B are another perspective views of a closed and an opened cover of light fixture with focusable LED light bulb from inside heat sink according to an embodiment of the invention.
Figure 3A:
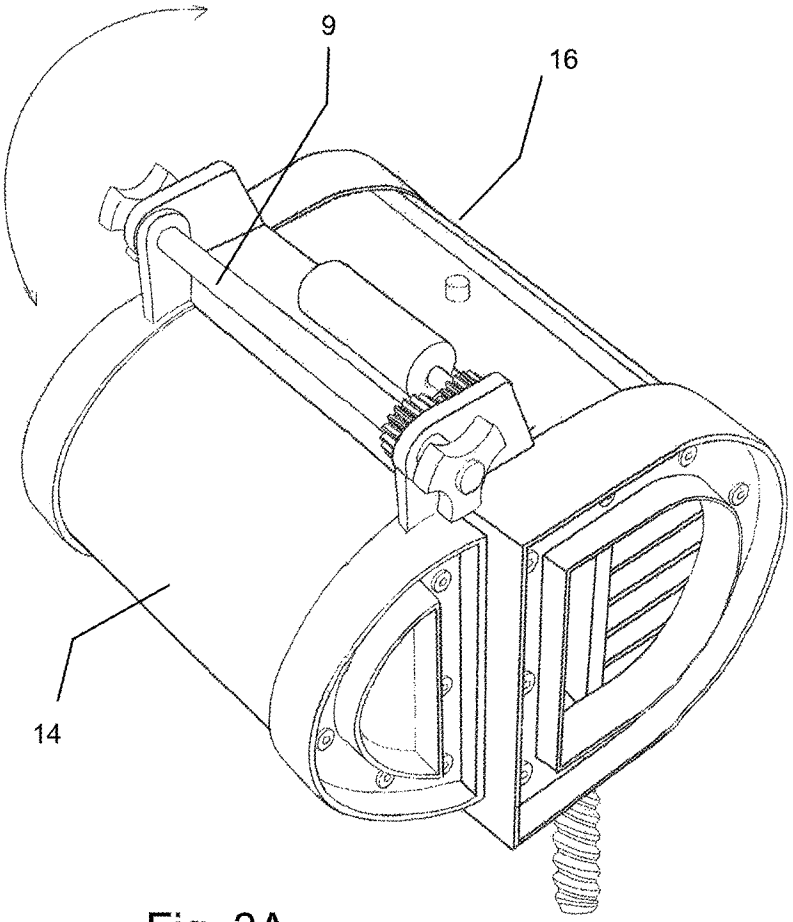

The U.S. Provisional Patent Application Ser. No. 62/486,402 for "Adjustable Focus LED Spotlight from Inside of LED Light Bulb or Fixtures with Interchangeable Bulb" filed on May 15, 2017, 62/576,976 for "Multi-adjustable Focus with Motor and Directional Inside LED Fixture" filed on Oct. 25, 2017, 62/585,488 for "LED Motor Controlled Spot Light with Built-in Flood Light on Cover" filed on Nov. 13, 2017, and 62/637,748 for "LED Light Bar with Motor Controlled Focusable LED Light on Inside the Heat Sink" filed on Mar. 2, 2018 are incorporated by reference herein for any and all purposes.

An aspect of the invention provides a focusable lighting system, comprising a base body (16), a first light source light source (11), a cover body (14), one or more second light sources (5), one or more convex lenses (1, 2), and a plurality of focus controllers (4', 4", 4'") as shown in FIGS. 1-6.

The base body (16) has front and rear surface portions, top and bottom surface portions, and two side surface portions.

The first light source (11) is disposed on the front surface portion of the base body (16).

The cover body (14) has a front opening portion connected to an inner space portion of the cover body (14), a rear cover portion, top and bottom edge portions provided between the front opening portion and the rear cover portion, and two side portions.

Each of the one or more second light sources (5) is disposed on a top surface of a first cylindrical platform in the inner space portion of the cover body, so as to illuminate a front side of the front opening portion through the front opening portion.

Each of the one or more convex lenses (1, 2) has a second cylindrical platform being installed on each of the one or more second light sources (5).

Each of the plurality of focus controllers (4', 4", 4'") is installed on each of the one or more convex lenses (1, 2) in the inner space portion of the cover body (14) and configured for controlling a distance between the corresponding second light source (5) and convex lens (1, 2) and providing a light beam ranging from a directional narrow focused spot light to a wide spreading flood light.

Each of the one or more focus controllers (4', 4", 4'") may be controlled remotely from outside using a remote (41), which may communicate with a circuit board (19) as shown in FIGS. 1 and 2, wirelessly or through wire.

Each of the one or more convex lenses (1, 2) may engage with a corresponding one of the one or more second light sources (5) through male and female threads (37, 38).

The male threads (38) may be provided on an outer circumferential side surface of the first cylindrical platform and the female threads (37) are provided on an inner surface of the second cylindrical platform, so that the male threads (38) and the female threads (37) engage and rotate against each other so as to change the distance between the second light source (5) and the convex lens (1, 2).

Each of the plurality of focus controllers (4', 4", 4'") may comprise a screw portion (37), and one or more gears (4', 4", 4'").

The screw portion (37) is provided on an outer surface of the second cylindrical platform of the convex lens (1, 2), and at least one of the one or more gears (4', 4", 4'") engages the screw portion (37). At least one of the one or more gears (4', 4", 4'") is rotated by an electric motor (not shown), which is engaged with the gear (4'") that engages the gear (4") engaging the gear (4') in a serial fashion. For an example, the convex lens (1) may be engaged with and controlled by the gear (4') and the convex lens (2) by the gear (4").

Figure 5:
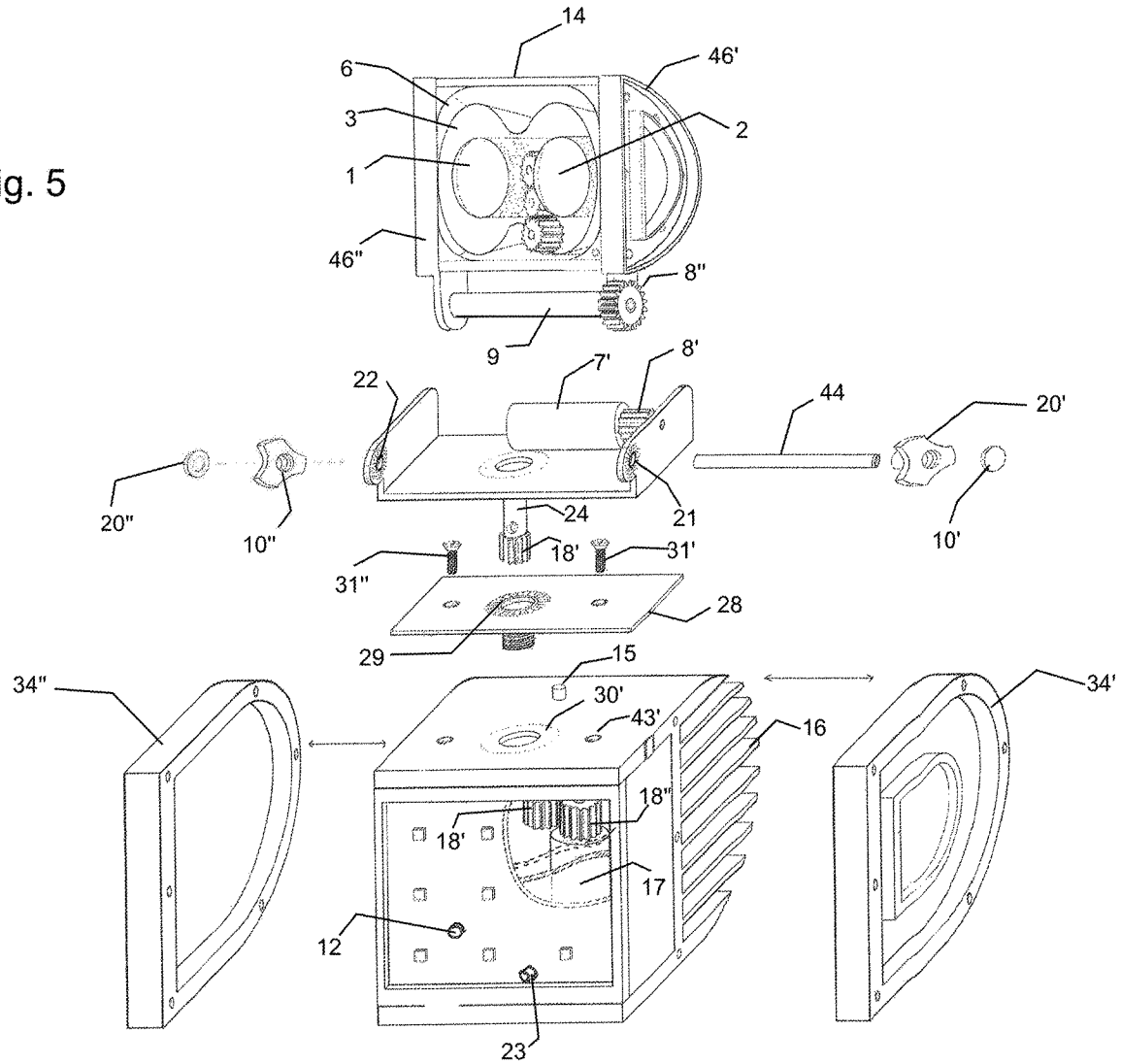
FIG. 5 is an exploded view of a light fixture with a focusable LED light bulb from inside heat sink according to an embodiment of the invention.

Each of the plurality of focus controllers (4', 4", 4'") may be configured to rotate one or more convex lenses (1, 2) as shown in FIGS. 1 and 5. How to use a plurality gears and a motor in order to engage and control the convex lenses (1, 2, or more) would be obtained by modifying the illustrated embodiment. The gear (4' or 4") engages with a corresponding gear teeth provided on the outer cylindrical surface of the second cylindrical platform of the convex lens (1 or 2). In such an engagement, if the gear (4' or 4") rotates, then the convex lens (1 or 2) rotates along, resulting in a linear motion in a direction of the cylindrical axis and changing the distance between the convex lens (1 or 2) and the second light source (5). However, the mechanism is not limited to the above. As long as it converts a rotational movement to a linear movement, any device can be applied.

The focusable lighting system may further comprise a hinge tube rod (9), a cover base board, two rod holes (21), a connecting rod (44), and an open-close motor (7') as shown in FIG. 5.

The hinge tube rod (9) has one end fixed to the cover body (14) and another end to an outer circumferential surface of which a hinge gear (8") is fixed.

The cover base board has a horizontal plate portion, two vertical side plate portions extending from two edge portions of the horizontal plate portions.

The two rod holes (21) are provided through the two vertical side plate portions.

The connecting rod (44) is queued through the two rod holes (21) and a center through-hole of the hinge tube rod (9), connecting rotatably the cover body (14) to the cover base board as shown in FIG. 5.

The open-close motor (7') has a motor rod (hidden) rotatably anchored to one of the two vertical side plate portions and a motor gear (8') that is configured to engage the hinge gear (8") and close or open the cover body (14) over the front surface portion of the base body (16) as shown in FIG. 5.

Figure 4:
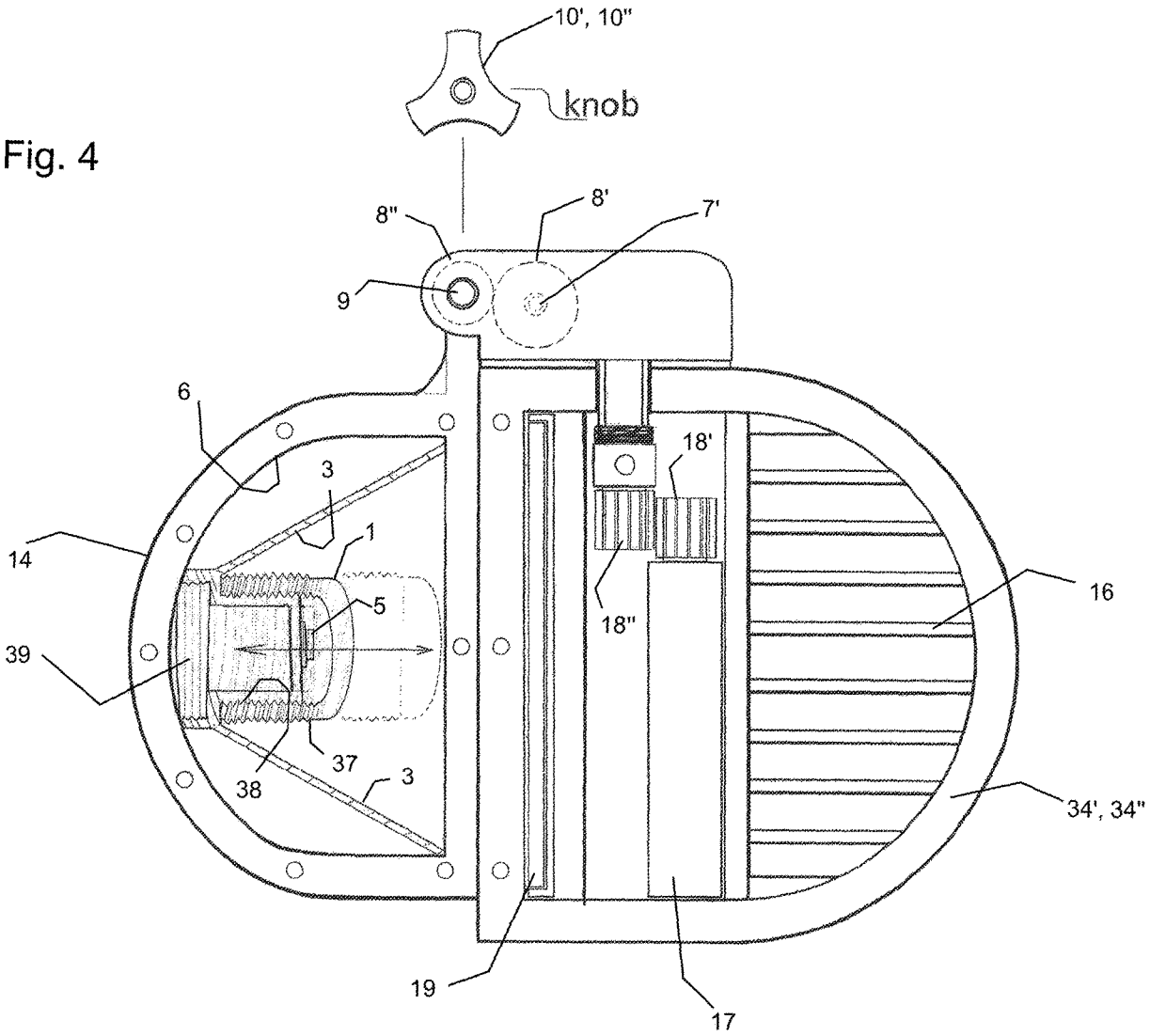
FIG. 4 is a cross sectional view of closed cover of light fixture with focusable LED light bulb from inside heat sink according to an embodiment of the invention.
Figure 6:
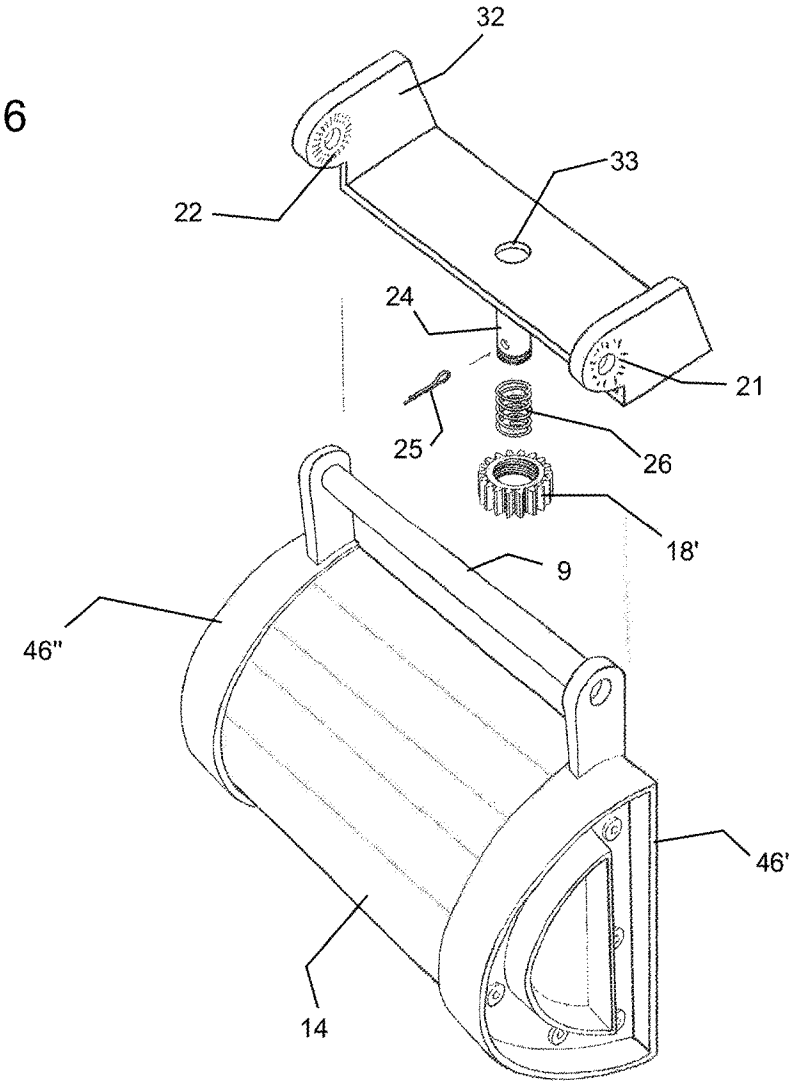
FIG. 6 is an exploded view of a cover of light fixture with focusable LED light bulb from inside heat sink according to an embodiment of the invention.
Figure 7:
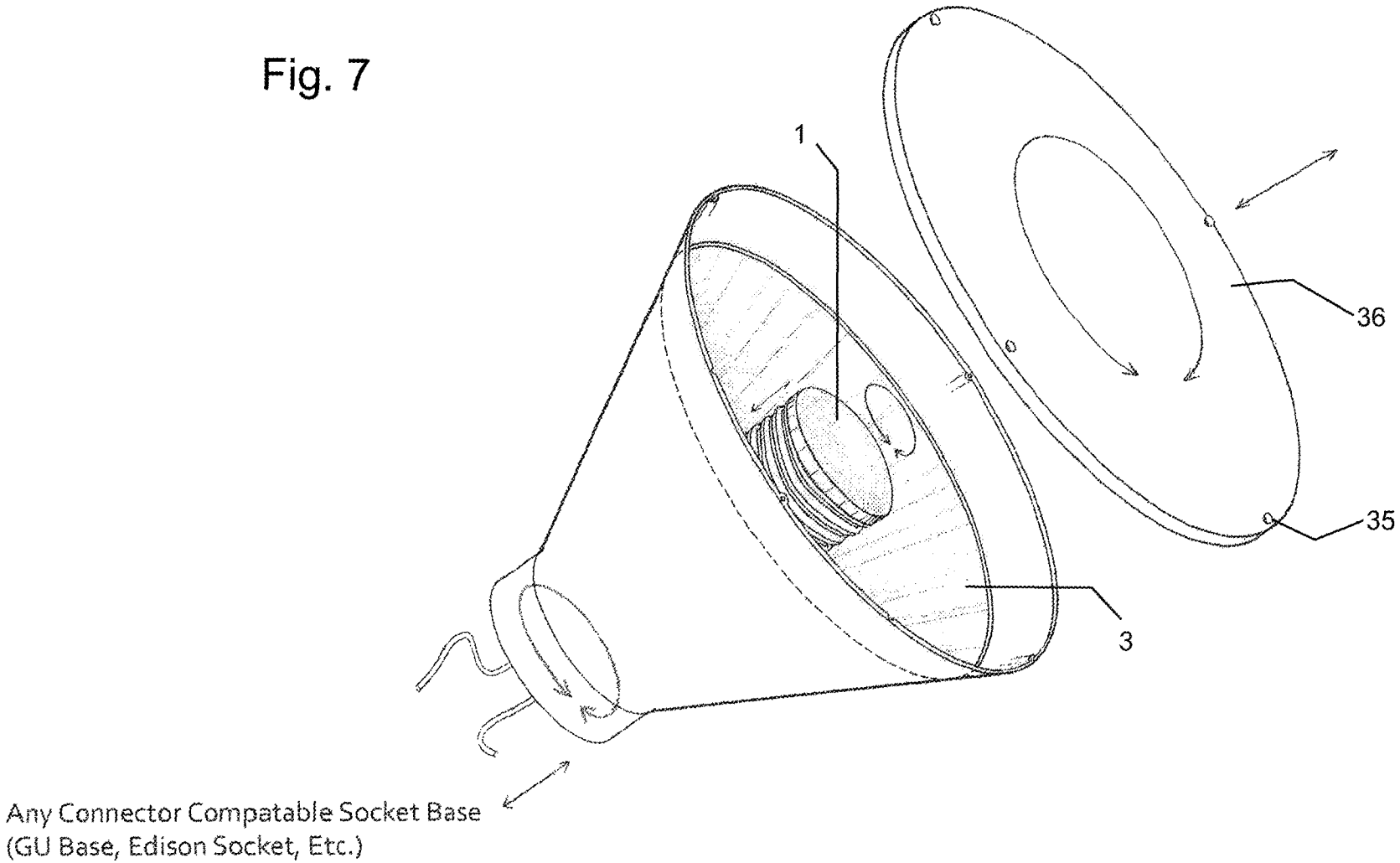
FIG. 7 is a perspective view of a focusable LED light bulb from inside the heat sink according to an embodiment of the invention.

The focusable lighting system may further comprise a connector rod (24), a swiveling gear (18'), and a swiveling motor (17) as shown in FIGS. 4-6.

The connector rod (24) extends downwards vertically from the cover base board into the base body (16).

The swiveling gear (18') is fixed to a lower end of the connector rod (24).

The swiveling motor (17) is provided in the base body (16) and having a motor gear (18") engaging the swiveling gear (18'), which are configured to swivel the cover base board and the cover body (14) together by rotating the connector rod (24) with respect to the base body (16).

Both ends of the connecting rod (44) may be fixed to the two vertical side plate portions with two handle knobs (10', 10") as shown in FIG. 5.

Figure 21:
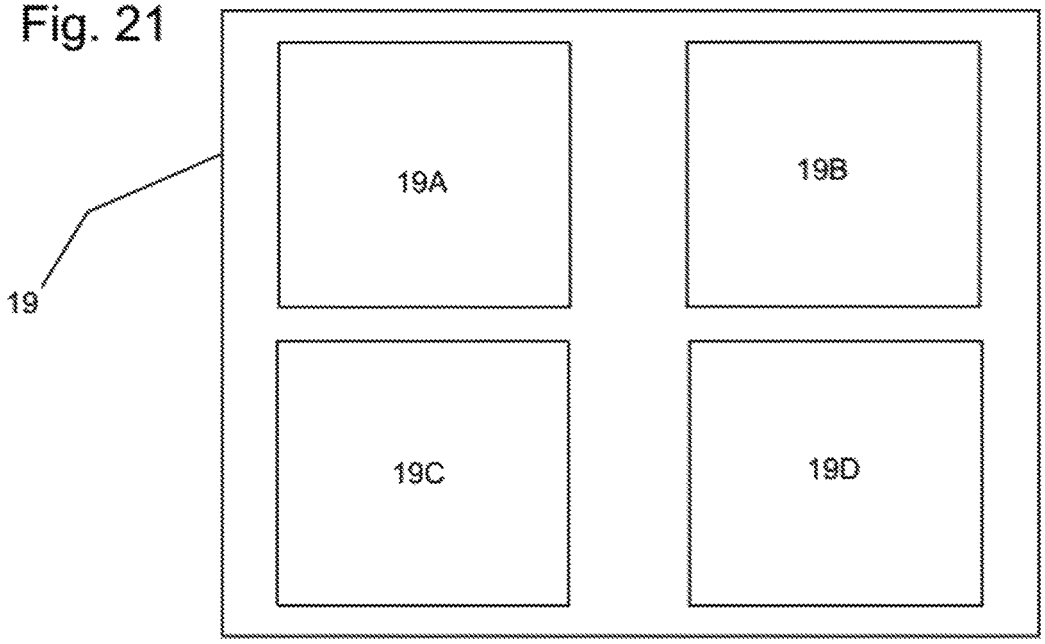
FIG. 21 is a block diagram showing a circuit board including first to fourth circuit portions according to still another embodiment of the invention.

The focusable lighting system may further comprise a circuit board (19) having a first circuit portion (19A) for operating the first and second light sources (1, 2, 11) and a second circuit portion (19B) for operating the open-close motor (7') and the swiveling motor (17) as shown in FIGS. 4 and 21.

The circuit board (19) may further comprise a third circuit portion (19C) for communicating with an remote control (41) through a wired or wireless communication as shown in FIGS. 1 and 2. In a still further embodiment of the invention, the circuit board (19) may further comprise a fourth circuit portion (19D) for controlling a motion sensor (12) as shown in FIGS. 1, 4, and 21. The output from the motion sensor (12) may be used to control the direction or the focusing distance of the beam coming through the convex lenses (1, 2).

In certain embodiments of the invention shown in FIGS. 7-13, each of the one or more focus controllers may be controlled manually.

Each of the plurality of focus controllers (4', 4", 4'") may be disposed in the cover portion (14), installed in the inner space portion of the cover body (16), installed on the second cylindrical platform of a corresponding convex lens (1, 2), and configured for controlling a distance between the corresponding second light source (5) and convex lens (1, 2) and providing a light beam ranging from a directional narrow focused spot light to a wide spreading flood light by rotating an outer handle portion (102) of the corresponding convex lens (1, 2) manually as shown in FIGS. 7-10.

Figure 8:
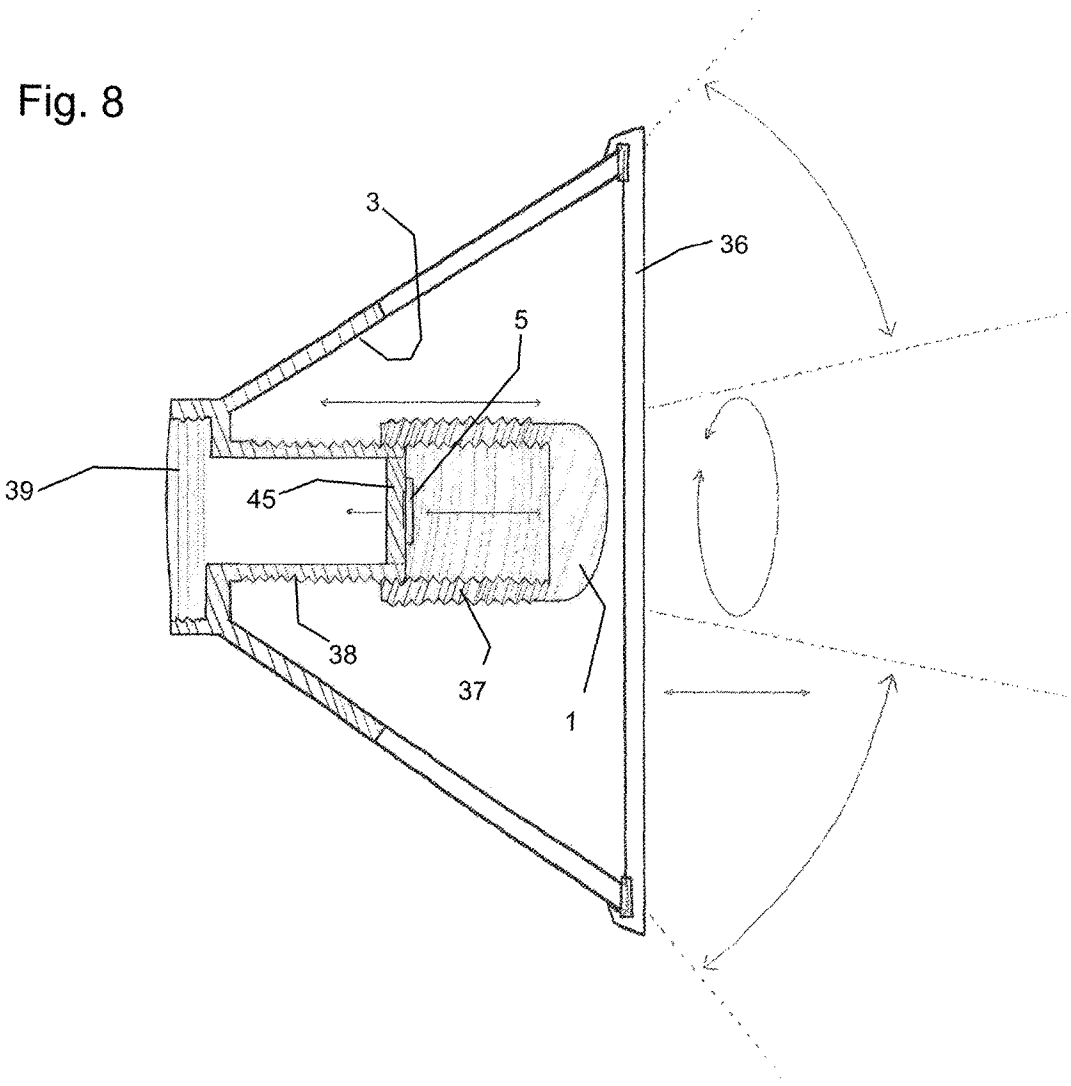
FIG. 8 is a cross sectional view of a focusable LED light bulb from inside the heat sink according to an embodiment of the invention.
Figure 10:
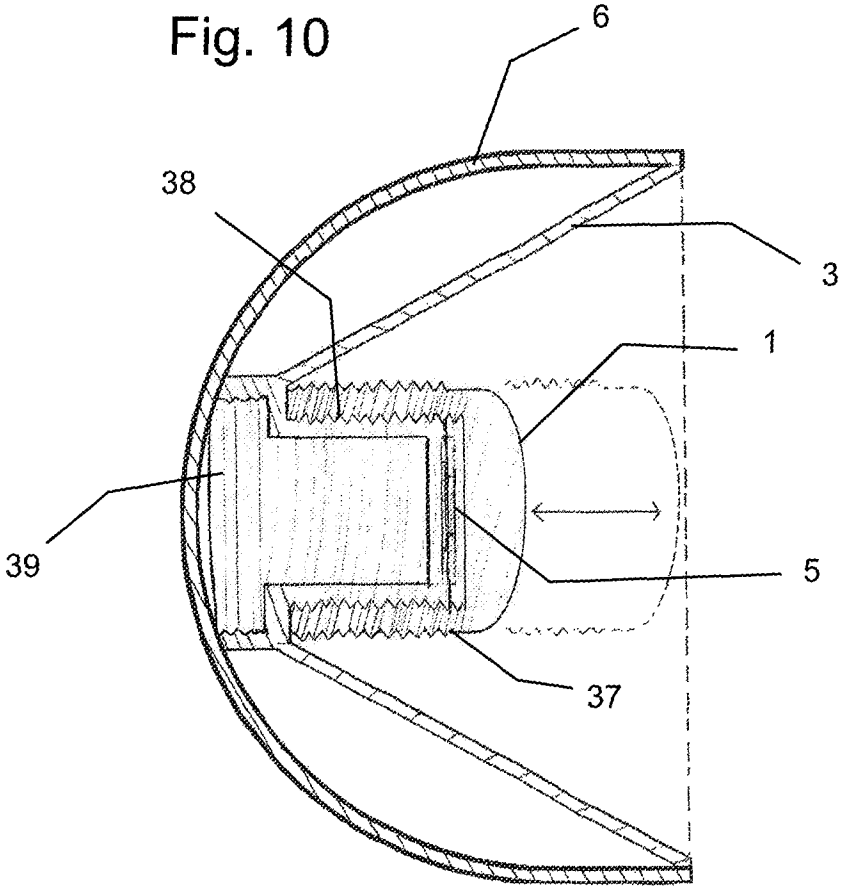
FIG. 10 is another cross sectional view of a focusable LED light bulb from inside the heat sink according to an embodiment of the invention.
Figure 9:
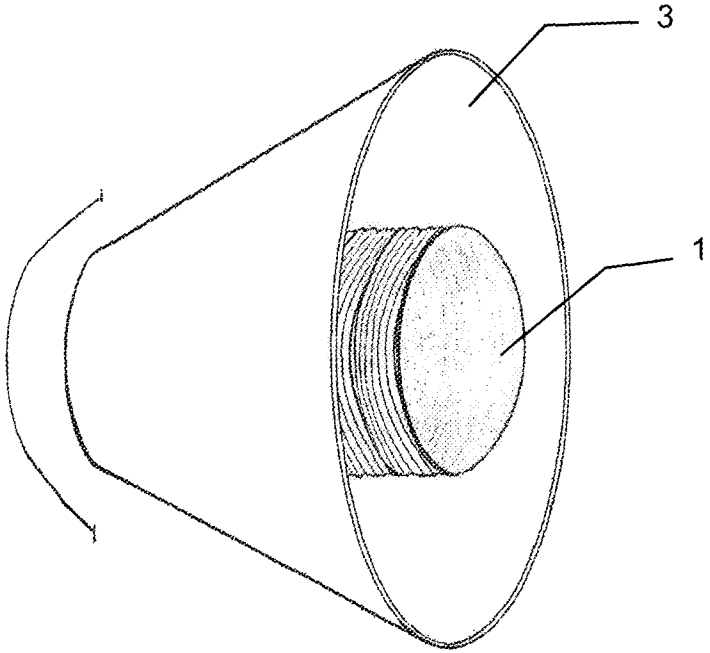
FIG. 9 is another perspective view of a focusable LED light bulb from inside the heat sink according to an embodiment of the invention.

Each of the one or more convex lenses (1, 2) engages with a corresponding one of the one or more second light sources (5) through male and female threads provided between the first cylindrical platform of the second light source (5) and the second cylindrical platform of the convex lens (1, 2) as shown in FIGS. 8 and 10.

The male threads may be provided on an outer circumferential side surface of the first cylindrical platform and the female threads are provided on an inner surface of the second cylindrical platform, so that the male threads and the female threads engage and rotate against each other so as to change the distance between the second light source (5) and the convex lens (1, 2).

Figure 12:
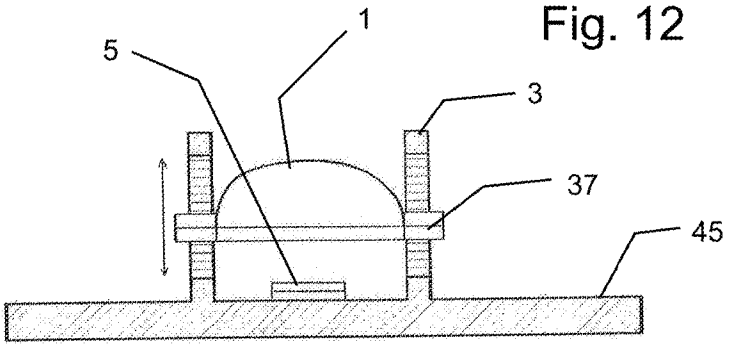
FIG. 12 is a cross sectional view of an assembled view of focusable LED light bulb from inside the heat sink according to an embodiment of the invention.
Figure 13:
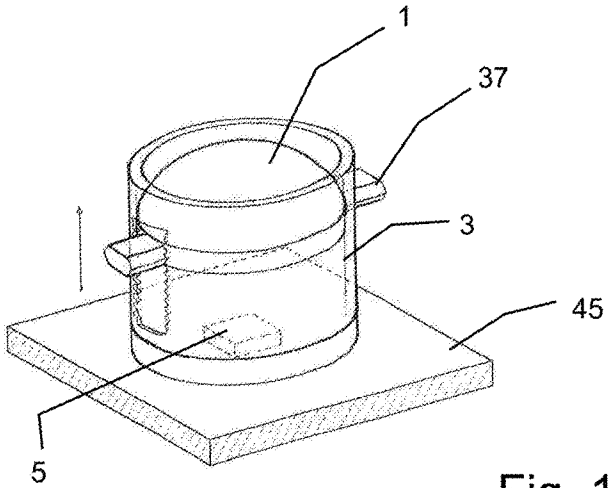
FIG. 13 is a perspective view of assembled view of focusable LED light bulb from inside the heat sink according to an embodiment of the invention.
Figure 11:
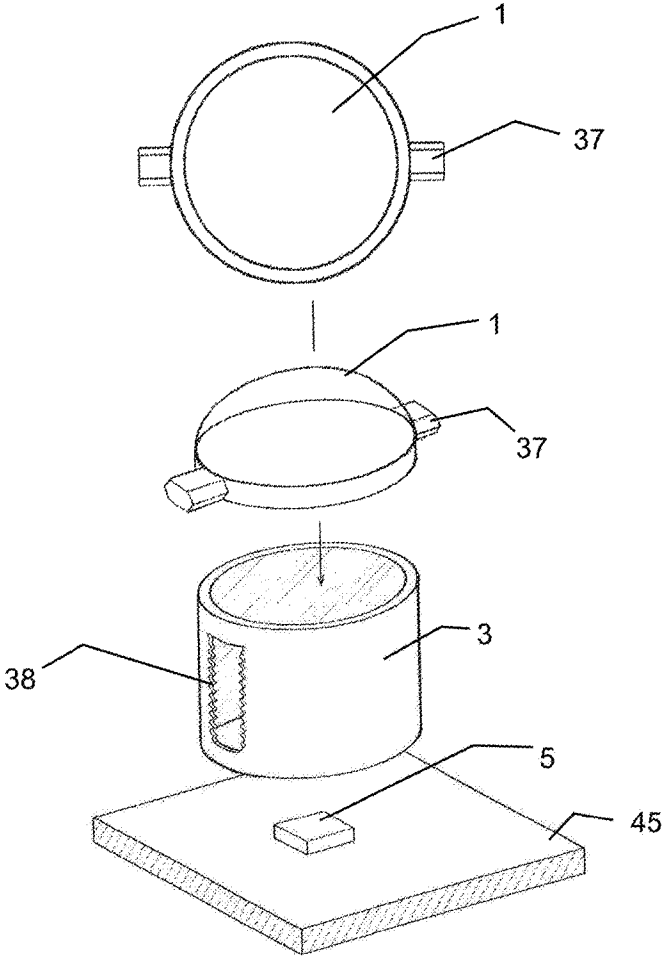
FIG. 11 is an exploded view of a focusable LED light bulb from inside the heat sink according to an embodiment of the invention.
Figure 14:
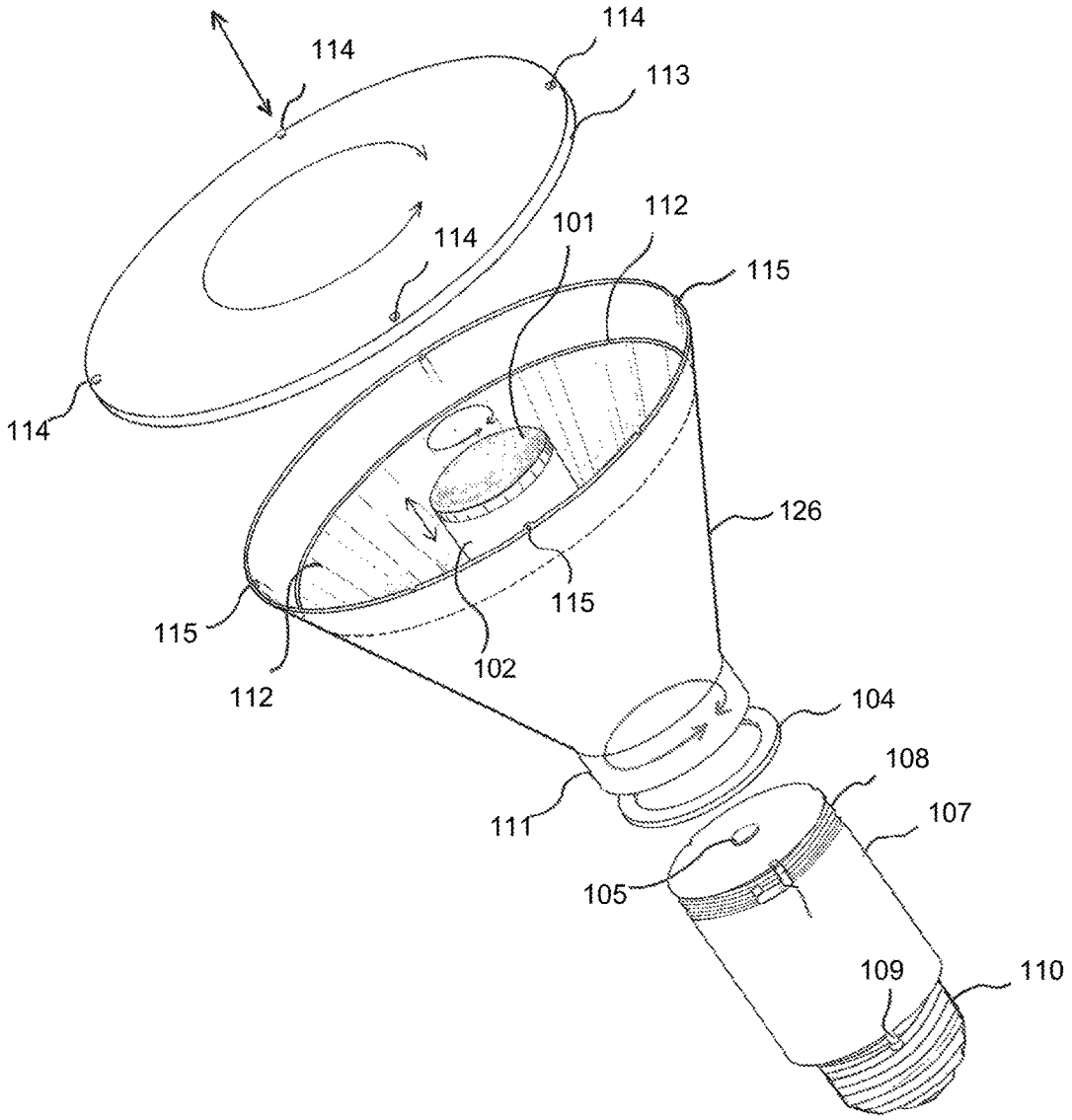
FIG. 14 is an exploded view showing an adjustable focus spot LED light bulb with multi-type fitting and cover according to another embodiment of the invention.
Figure 15:
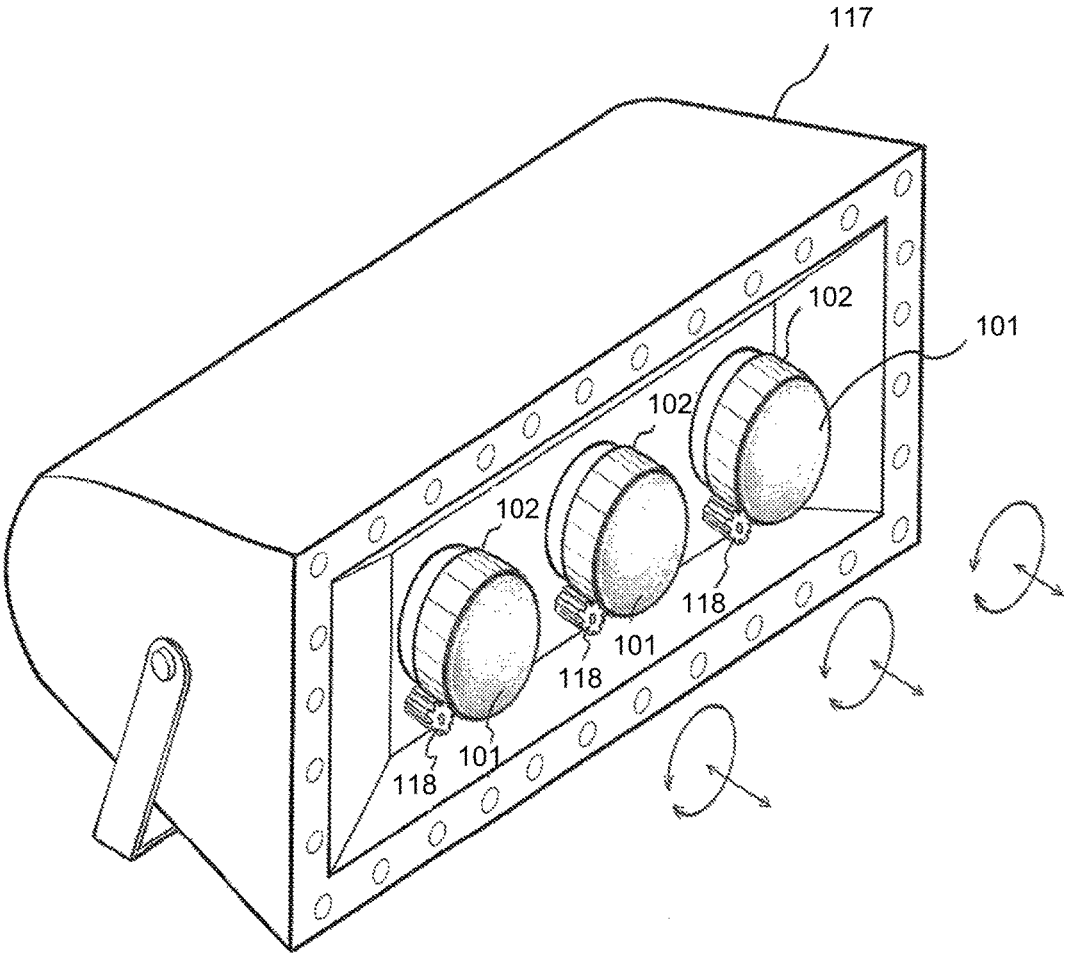
FIG. 15 is a perspective view showing an individual gear to control the focus of LED light on wall pack light or LED street light or vehicle LED light bar according to still another embodiment of the invention.
Figure 19:
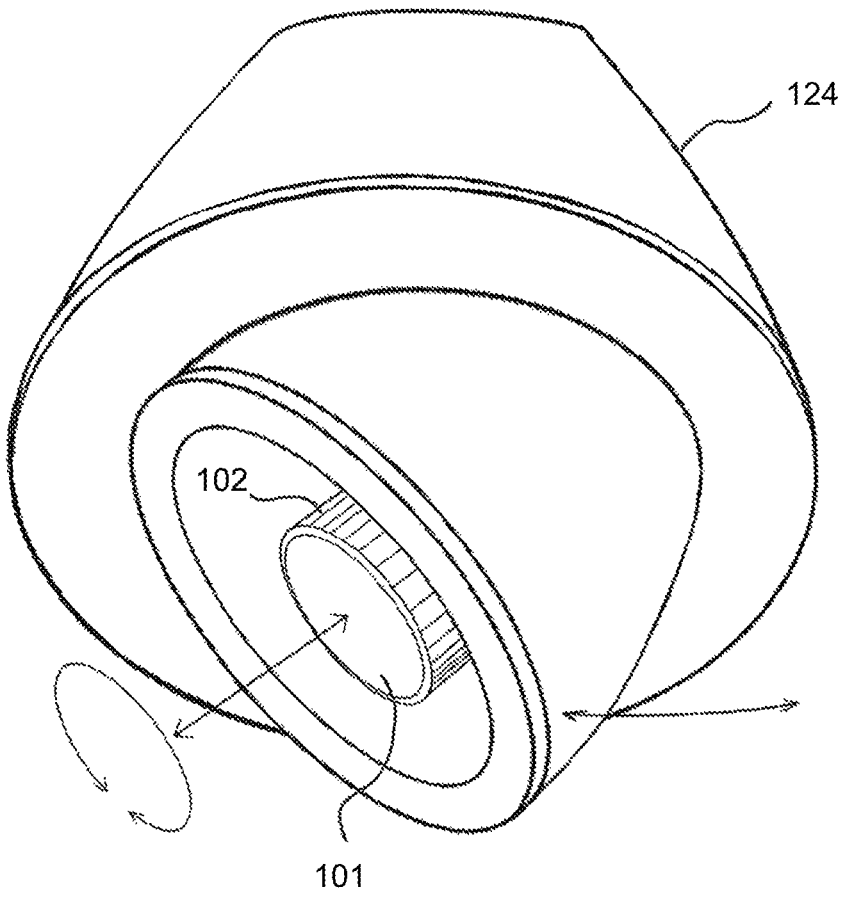
FIG. 19 is a perspective view showing an adjustable focus spot LED light on an recessed adjustable/directional lighting according to still another embodiment of the invention.
Figure 20:
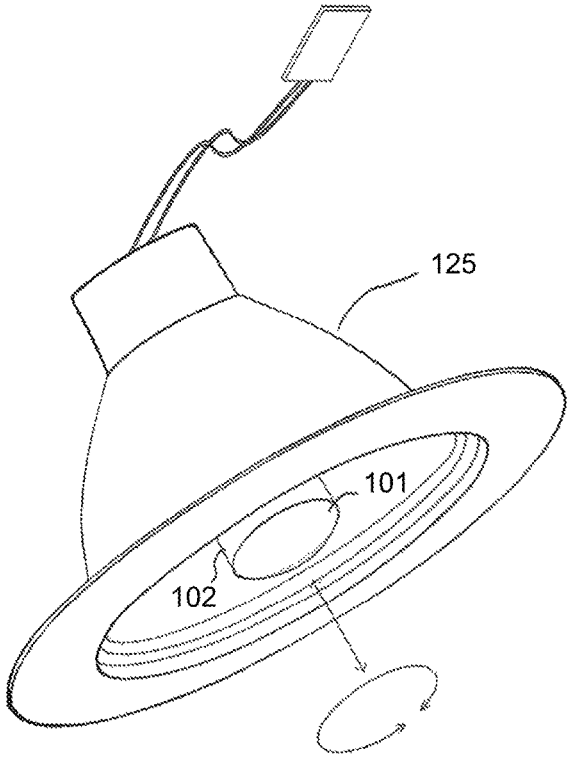
FIG. 20 is a perspective view showing an adjustable focus spot LED light on an recessed LED downlighting according to still another embodiment of the invention.

Each of the plurality of focus controllers may be disposed in the cover portion, installed in the inner space portion of the cover body, installed on the second cylindrical platform of a corresponding convex lens, and configured for controlling a distance between the corresponding second light source and convex lens and providing a light beam ranging from a directional narrow focused spot light to a wide spreading flood light by pushing in or out the corresponding convex lens (1, 2) manually as shown in FIGS. 11-13.

Each of the one or more convex lenses (1, 2) may engage with a corresponding one of the one or more second light sources (5) through a side screw handle (37) provided on the first cylindrical platform of the convex lens (1, 2) and a side screw (38) provided along a rectangular cutout through the second cylindrical platform of the convex lens (1, 2), so as to be configured that the side screw handle (37) of the convex lens (1, 2) is latched at a notch of the side screw (38), providing a specific interval between the convex lens (1, 2) and the second light source (5).

The first cylindrical platform of the convex lens (1, 2) may be provided along an edge portion of the convex lens (1, 2) as shown in FIG. 11.

As shown in FIGS. 14-20, still another aspect of the invention provides an adjustable focus LED spotlight from inside of LED light bulb or fixtures with interchangeable bulb.

Conventional LED lighting devices that are equipped with adjustable focused spotlights are controlled mainly from outside of the body. The devices that are equipped with adjustable focus light beams can be found on flash light or on some other lighting fixtures. But these are mainly controlled from outside that will change the length of the controller and thus the device will looks protrude from the main body of lighting device and looks not appeasing to the eyes. And since it is specially designed for the limited usage and restricted purpose, it is expensive. Another issue can be found in PAR light bulbs that has limited space from outside body and will be difficult to apply the adjustable focus LED light beam mechanism on outside of the body of light bulb. Current LED bulb and driver are attached and glued together and cannot be adapt/fitted to or with other type and shapes of bulbs.

To solve the above problems, the invention provides an adjustable focus spotlight on the inside the body of light bulb or fixtures. Since the adjustable focused lighting handle (102) is located inside the bulb or fixtures, it looks natural and looks just as same as other regular type of bulb or fixtures. The converging lens (101) is located inside the body of bulb/fixture and can be controlled the spreading of angle of the light by zooming in or out the converging lens. By zooming in and out the handle (102), it can provide either clear directional narrow focused spot light or wide spreading flood light.

Zooming in and out can be done in: turn clockwise or counterclockwise along the thread line; or it could also be pushed in or out; or stepping click in or stepping click out.

By providing the adjustable focus LED light handle inside the PAR bulb, it can easily and freely be able to focus the light from intense direct narrow angle focus light beam to wide spread of flood light easily. Thus, there is no need to purchase spot light or flood light on each different usage. Another advantage of this current invention is that many different shape of type of bulbs can be fit into same standard Edison base. Since the top part of the bulb shape can be easily attached or detached with many different type of shape of bulbs, it can be adapt into different design (126-132) and looks that fits on different occasion. When the bulb cover (113) and bottom of bulb shape that screw into the body of base (107), the gasket (104, 116) is provided to prevent the water or moisture getting into the device. When top part of cover (113) needs to be unscrewed, it can also unscrew the bottom base screw (111) at the same time. It can be prevented by providing secure lock (106) on standard base (107) that will prevent the turning of both top cover (113) and bottom screw base (111) at the same time. The bulb base (111) will be loosened only when the body of bulb (126-132) is pressed down and turn counterclockwise.

The bottom base (from 111 and 108)

- can be turn clockwise or counterclockwise according to thread for fastening or detaching each other,
- can be plug in or plug out for fastening or detaching,
- can be step in or step out for fastening or detaching each other,
- can be click in or click out it for fastening or detaching each other.

Another advantage of this invention is it doubles the brightness by using light comes out through converging lens and it adds brightness through reflection on reflector (112). Another advantage to use focus light is that it can be also applied in motor for controlling the focus of light. Motor can control individual LED light (FIG. 15) or it can control all lights at the same time by gear belt. Another advantage of the invention is to provide a front cover (113) that can be replaced with different type of cover. It can be switched to transparent, or clear or foggy or textured or choice of colors or designs.

The top cover (from 113 and 126 and other shapes)

- can be turn toward clockwise or counterclockwise toward the thread direction for fastening or detaching,
- can be screwed into the top round edge (115) of bulb shape for fastening or detaching,
- can be step in or step out by pushing in or pulling out for fastening or detaching each other.

REFERENCE NUMERALS IN FIGS. 1-13

1, 2: convex light bulb lens
3: heat sink
4', 4", 4'": gear
5: LED
6: light fixture body
7': motor
7": motor spin rod
8': gear from motor
8": gear attached to motor
9: hinge tube rod
10', 10": knob
11: LED
12, 13: auto tracking moving object sensor
14: cover body
15: rubber
16: base body with heat sink
17: motor
18', 18": gear
19: circuit board
20', 20": cap nut
21, 22, friction grid
24: connector rod
25: secure pin
26: spring
27: gear

28: metal plate (to prevent abrasion like aluminum from movement)
29, 30: friction grid
31', 31": screw
32: cover base board
33: friction grid
35: screw
34', 34": side bracket of base light fixture
36: light fixture bulb housing cover
37: convex lens body side screw
38: LED body side screw
39: socket base
40: fixture mount bolt
41: remote controller
42: metal plate mount base
43', 43": screw hole
44: rod for handle knob 45: LED base body plate
46', 46": cover side bracket

REFERENCE NUMERALS IN FIGS. 14-20

101: converging lens
102: outer adjustable focus lens controller handle body
103: inner adjustable focus lens controller body
104: gasket
105: LED
106: secure lock
107: standard socket base
108: round screw type
109: GU base
110: Edison socket
111: outer base screw
112: heat sink with reflector
113: bulb front cover
114: screw hole
115: screw hole
117: body of wall pack/vehicle LED lightbar/street lamp
118: gear
121: body of wall pack LED lighting
122: body of LED street lamp lighting
123: body of vehicle LED light bar
124: recessed adjustable/directional lighting
125: recessed LED down light While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A focusable lighting system comprising:

a base body having front and rear surface portions, top and bottom surface portions, and two side surface portions;

a first light source disposed on the front surface portion of the base body;

a cover body having a front opening portion connected to an inner space portion of the cover body, a rear cover portion, top and bottom edge portions provided between the front opening portion and the rear cover portion, and two side portions;

one or more second light sources, each of which being disposed on a top surface of a first cylindrical platform in the inner space portion of the cover body so as to illuminate a front side of the front opening portion through the front opening portion;

one or more convex lenses, each of which having a second cylindrical platform being installed on each of the one or more second light sources; and a plurality of focus controllers, each of which being installed on each of the one or more convex lenses in the inner space portion of the cover body and configured for controlling a distance between the corresponding second light source and convex lens and providing a light beam ranging from a directional narrow focused spot light to a wide spreading flood light.

2. The focusable lighting system of claim 1, wherein each of the one or more focus controllers is controlled remotely from outside.

3. The focusable lighting system of claim 2, wherein each of the one or more convex lenses engages with a corresponding one of the one or more second light sources through male and female threads.

4. The focusable lighting system of claim 2, further comprising:

a hinge tube rod having one end fixed to the cover body and another end to an outer circumferential surface of which a hinge gear is fixed;

a cover base board having a horizontal plate portion, two vertical side plate portions extending from two edge portions of the horizontal plate portions;

two rod holes provided through the two vertical side plate portions;

a connecting rod queued through the two rod holes and a center through-hole of the hinge tube rod, connecting rotatably the cover body to the cover base board; and an open-close motor having a motor rod rotatably anchored to one of the two vertical side plate portions and a motor gear that is configured to engage the hinge gear and close or open the cover body over the front surface portion of the base body.

5. The focusable lighting system of claim 2, further comprising a circuit board having a first circuit portion for operating the first and second light sources and a second circuit portion for operating an open-close motor and a swiveling motor.

6. The focusable lighting system of claim 3, wherein the male threads are provided on an outer circumferential side surface of the first cylindrical platform and the female threads are provided on an inner surface of the second cylindrical platform, so that the male threads and the female threads engage and rotate against each other so as to change the distance between the second light source and the convex lens.

7. The focusable lighting system of claim 4, further comprising:

a connector rod extending downwards vertically from the cover base board into the base body;

a swiveling gear fixed to a lower end of the connector rod; and a swiveling motor provided in the base body and having a motor gear engaging the swiveling gear, which are configured to swivel the cover base board and the cover body together by rotating the connector rod.

8. The focusable lighting system of claim 5, wherein the circuit board further comprises a third circuit portion for communicating with an remote control through a wired or wireless communication.

9. The focusable lighting system of claim 6, wherein each of the plurality of focus controllers comprises:

a screw portion provided on an outer surface of the second cylindrical platform of the convex lens; and one or more gears, at least one of which engaging the screw portion, wherein at least one of the one or more gears is rotated by an electric motor.

10. The focusable lighting system of claim 9, wherein each of the plurality of focus controllers is configured to rotate one or more convex lenses.

11. The focusable lighting system of claim 10, wherein both ends of a connecting rod are fixed to two vertical side plate portions with two handle knobs.

12. The focusable lighting system of claim 1, wherein each of the one or more focus controllers is controlled manually.

13. The focusable lighting system of claim 12, wherein each of the plurality of focus controllers is disposed in the inner space portion of the cover body, installed on the second cylindrical platform of a corresponding convex lens, and configured for controlling a distance between the corresponding second light source and convex lens and providing a light beam ranging from a directional narrow focused spot light to a wide spreading flood light by rotating an outer handle portion of the corresponding convex lens manually.

14. The focusable lighting system of claim 12, wherein each of the one or more convex lenses engages with a corresponding one of the one or more second light sources through male and female threads.

15. The focusable lighting system of claim 12, wherein each of the plurality of focus controllers is disposed in the inner space portion of the cover body, installed on the second cylindrical platform of a corresponding convex lens, and configured for controlling a distance between the corresponding second light source and convex lens and providing a light beam ranging from a directional narrow focused spot light to a wide spreading flood light by pushing in or out the corresponding convex lens manually.

16. The focusable lighting system of claim 14, wherein the male threads are provided on an outer circumferential side surface of the first cylindrical platform and the female threads are provided on an inner surface of the second cylindrical platform, so that the male threads and the female threads engage and rotate against each other so as to change the distance between the second light source and the convex lens.

17. The focusable lighting system of claim 15, wherein each of the one or more convex lenses engages with a corresponding one of the one or more second light sources through a side screw handle provided on a first cylindrical platform of the convex lens and a side screw provided along a rectangular cutout through the second cylindrical platform of the convex lens, so as to be configured that the side screw handle of the convex lens is latched at a notch of the side screw, providing a specific interval between the convex lens and the second light source.

18. The focusable lighting system of claim 15, wherein the first cylindrical platform of the convex lens is provided along an edge portion of the convex lens.

* * * * *